US008652015B2

(12) United States Patent
Casadei et al.

(10) Patent No.: US 8,652,015 B2
(45) Date of Patent: Feb. 18, 2014

(54) SAFETY DEVICE

(75) Inventors: Marco Casadei, Montecolombo (IT); Davide Neri, Faenza (IT)

(73) Assignee: Technogym S.p.A., Gambettola (FC) (IT)

( * ) Notice: Subject to any disclaimer, the term of this patent is extended or adjusted under 35 U.S.C. 154(b) by 487 days.

(21) Appl. No.: 12/953,996

(22) Filed: Nov. 24, 2010

(65) Prior Publication Data

US 2011/0130252 A1 Jun. 2, 2011

(30) Foreign Application Priority Data

Nov. 27, 2009 (IT) ..... RA2009A0045

(51) Int. Cl.
*A63B 21/062* (2006.01)
*A63B 21/068* (2006.01)

(52) U.S. Cl.
USPC ..... 482/94; 482/99

(58) Field of Classification Search
USPC ..... 482/92–105
See application file for complete search history.

(56) References Cited

U.S. PATENT DOCUMENTS 2,803,087 A * 8/1957 Zalkind ..... 446/473
2,998,974 A * 9/1961 Stafford ..... 463/47.1
3,065,962 A * 11/1962 Hoffmeister ..... 482/75
3,075,767 A * 1/1963 Ono ..... 482/82
3,110,492 A * 11/1963 Hoffmeister ..... 482/76
3,268,223 A * 8/1966 Woodsum, Jr. ..... 472/14
4,275,880 A * 6/1981 Murphy ..... 482/43
4,340,215 A * 7/1982 Murphy ..... 482/43
4,340,216 A * 7/1982 Murphy ..... 482/43
4,478,420 A * 10/1984 Sowards ..... 473/435
4,651,987 A * 3/1987 Day ..... 482/123
4,842,271 A * 6/1989 Vinciguerra ..... 482/100
4,921,245 A * 5/1990 Roberts ..... 482/42
5,102,122 A * 4/1992 Piane et al. ..... 482/133
5,643,152 A * 7/1997 Simonson ..... 482/100
5,769,762 A * 6/1998 Towley et al. ..... 482/93
5,779,601 A * 7/1998 Ish, III ..... 482/100
5,779,604 A * 7/1998 Towley et al. ..... 482/108
5,971,899 A * 10/1999 Towley et al. ..... 482/108
6,083,144 A * 7/2000 Towley et al. ..... 482/107
6,283,899 B1 * 9/2001 Charnitski ..... 482/110
6,398,694 B1 * 6/2002 Bountourakis ..... 482/44
6,551,216 B2 * 4/2003 Rennex ..... 482/35

(Continued)

FOREIGN PATENT DOCUMENTS

WO WO 2006/017680 A2 2/2006
WO WO 2006/017680 A3 2/2006

OTHER PUBLICATIONS

European Search Report dated Jul. 26, 2010.

*Primary Examiner* — Stephen Crow
(74) *Attorney, Agent, or Firm* — Abelman, Frayne & Schwab

(57) ABSTRACT

A safety device (20) for a gymnastic machine (1) provided with a frame (5) and with a gravitational load group (10) connected to an interface (2) designed to allow a user of the gymnastic machine (1) to perform exercises against the action of the load group (10); the load group (10) comprising a movable equipment (19) provided with at least one load element (11) carried, in a freely sliding manner along a given direction (V), by respective guiding elements (12) associated to the frame (5); the safety device (1) comprising a return group (21) suitable, in use, to exert a given return force (F) on the movable equipment (19) so as to prevent substantially inertial ascending displacements thereof.

13 Claims, 3 Drawing Sheets

(56) References Cited

U.S. PATENT DOCUMENTS

| | | | | |
|---|---|---|---|---|
| 6,561,956 | B1 | 5/2003 | Allison | |
| 6,575,882 | B2 * | 6/2003 | Chen | 482/98 |
| 6,595,903 | B2 * | 7/2003 | Nerio et al. | 482/100 |
| 6,669,600 | B2 * | 12/2003 | Warner | 482/8 |
| 7,244,216 | B2 * | 7/2007 | Rastegar | 482/15 |
| 7,331,911 | B2 * | 2/2008 | Webber et al. | 482/137 |
| 7,553,262 | B2 * | 6/2009 | Piane, Jr. | 482/99 |
| 7,572,190 | B2 * | 8/2009 | Habing | 472/110 |
| 7,717,832 | B2 * | 5/2010 | Webber et al. | 482/100 |
| 2006/0105888 | A1 | 5/2006 | Piane | |
| 2006/0135329 | A1 * | 6/2006 | Owen | 482/123 |
| 2006/0189457 | A1 | 8/2006 | Ripley | |
| 2007/0060445 | A1 * | 3/2007 | Reinkensmeyer et al. | 482/1 |
| 2007/0225123 | A1 * | 9/2007 | Rastegar | 482/15 |
| 2008/0064570 | A1 * | 3/2008 | Rastegar | 482/15 |
| 2008/0176716 | A1 * | 7/2008 | Boren | 482/51 |
| 2011/0130252 | A1 * | 6/2011 | Casadei et al. | 482/93 |

* cited by examiner

Fig. 2B
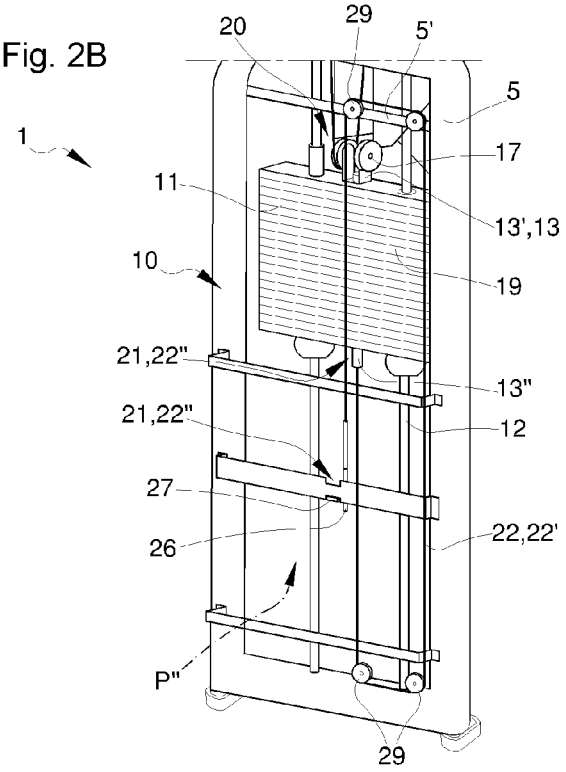
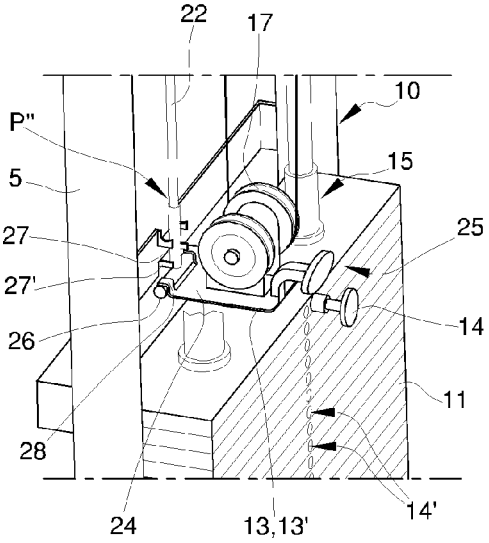
Fig. 3

SAFETY DEVICE

FIELD OF THE INVENTION

The present invention relates to a safety device. In particular, the present invention relates to a safety device for gymnastic machines. In more detail, the present invention relates to a safety device usable to prevent injuries in gymnastic machines provided with a gravitational load group.

BACKGROUND TO THE INVENTION

In the field of the gymnastic machines the use of gravitational load groups is well known, wherein the resistive action against the physical activity of a user is exerted by one or more load elements, for instance metallic bodies usually indicated as "weights" or "bricks", moved against the action of the gravitational force. As used herein, the term "gymnastic machine" is equivalent to "exercise machine". A gravitational load group of the known type is illustrated in FIG. 1 just by way of example. As used herein, the term "gravitational load group" is equivalent to "weights" or "bricks". This load group comprises vertical guides carried integrally by a respective frame, and a movable equipment consisting of a support member, often indicated as "spider", and two or more weights carried in a freely sliding manner by the vertical guides and stably connected to the respective support member. In particular, the support member comprises a head portion, arranged at the top, and a coupling portion, constituted by a bar presenting a plurality of substantially horizontal first holes arranged in a stepped manner. Similarly, each weight presents a substantially horizontal second through hole so that it is possible to couple to the spider a number of weights, and therefore a resistive load, that can be selected by the user substantially at will simply inserting a blocking pin in this second hole and in the first corresponding hole. In use, the head portion of the coupling member of the weights is connected to a respective interface, for example a gymnastic implement, through a mechanical transmission group, so that the actuation of this interface by a user of the respective gymnastic machine can occur against the resistance exerted by lifting the movable equipment of the gravitational load group. Referring to FIG. 1 just by way of example, this transmission group comprises a traction cable maintained tensioned between a plurality of return members, generally constituted by pulley.

At this point it should be noted that the known gravitational load groups, as that illustrated in FIG. 1, present drawbacks entailing the risk of injuries for the users of the respective gymnastic machines. These drawbacks are particularly evident when a user uses reduced loads for executing physical exercises involving at least one series of fast repetitions of a given athletic movement. Actually, under these training conditions, when a user performs an exercise particularly intensely and very fast, the movable equipment picks up high speed and tends to follow a substantially inertial ascending motion, i.e. it is subjected to a vertical ascending displacement along the respective guides that continues also when the action exerted by the user on the respective interface ends. This substantially inertial ascending motion can be also defined as a motion without synchronicity between the exertion by the user of a force on the interface and the movement of the movable equipment along the respective vertical guides. It should be noted that, in the presence of these substantially inertial motions of the movable equipment of the load group, two different drawbacks can occur, in succession or independently one of the other: first of all, the movable equipment, continuing rising, can impact against the frame portion acting as a stop for the guides. In addition to cause noise, extremely unpleasant for a user who wants to focus on the execution of the respective physical exercises, this circumstance can clearly lead to an undesired damage of the load group and/or of the transmission group connecting it to the respective interface. In addition to this, it should be noted that, following each substantially inertial ascending displacement, the movable equipment is subjected to a descending motion in substantially free fall, usually ending with a sudden and unexpected tension of the respective traction cable, and therefore with the transmission of a force pulse along this cable. This impulsive action can achieve the user, who will be subjected to a sharp and unexpected traction by the respective interface. This traction is generally felt by the user as a recoil coming from the load group, and can cause not only an interruption or an unbalance in executing the physical exercises, but also an undesired injury of the user's body portion involving the respective interface.

In view of the above description it is therefore clearly apparent that the use of known gravitational load groups in the gymnastic machines entails drawbacks that have been not still addressed and that are potentially dangerous for the users of these machines. In particular, the problem of having available a safety device for gravitational load groups usable to prevent substantially inertial ascending motions of the movable equipment while executing physical exercises is currently unsolved. In more detail, it would be desirable to have available a safety device which allows a movable equipment to translate freely upwards along the respective guides when it is subjected to the action exerted by a user, but which prevents, or at least minimises, any further ascending displacement of the movable equipment after the end of the action exerted by this user.

SUMMARY OF THE INVENTION

The present invention relates to a safety device. In particular, the present invention relates to a safety device for gymnastic machines. In more detail, the present invention relates to a safety device usable to prevent injuries in gymnastic machines provided with a gravitational load group.

An object of the present invention is to provide a safety device usable on a gymnastic machine in combination with a gravitational load group to prevent substantially inertial ascending displacements of the respective movable equipment. This safety device allows to solve the above illustrated drawbacks, and it is therefore suitable to satisfy a plurality of requirements that to date have still not been addressed and therefore suitable to represent a new and original source of economic interest, capable of modifying the current market of the gymnastic machines provided with gravitational load groups.

According to the present invention, a safety device is provided, whose main characteristics will be described in at least one of the appended claims.

A further object of the present invention is to provide a gravitational load group for gymnastic machines that allows the disadvantages described above to be solved, and can be therefore used safely by each user of a respective gymnastic machine.

According to the present invention, a load group for gymnastic machines is provided, whose main characteristics will be described in at least one of the appended claims.

A further object of the present invention is to provide a gymnastic machine provided with a gravitational load group that allows the disadvantages described above to be solved, and can be therefore used safely by each respective user.

According to the present invention, a load group for gymnastic machines is provided, whose main characteristics will be described in at least one of the appended claims.

A further object of the present invention is to provide a method validly usable to safeguard a gravitational load group for gymnastic machines.

According to the present invention a method is provided for safeguarding a gravitational load group for gymnastic machines, and the main characteristics of this method will be described in at least one of the appended claims.

BRIEF DESCRIPTION OF DRAWINGS

Further characteristics and advantages of the safety device according to the present invention will be more apparent from the description below, set forth with reference to the accompanying drawings, which illustrate some non-limiting examples of embodiment, in which identical or corresponding parts of the device are identified by the same reference numbers. In particular:

FIG. 2B is a view in enlarged scale and with some parts removed for the sake of clarity of a detail of FIG. 2A;

FIG. 3 is a view in enlarged scale and with some parts removed for the sake of clarity of a detail of FIG. 2B.

DETAILED DESCRIPTION OF THE INVENTION

Figure 1:
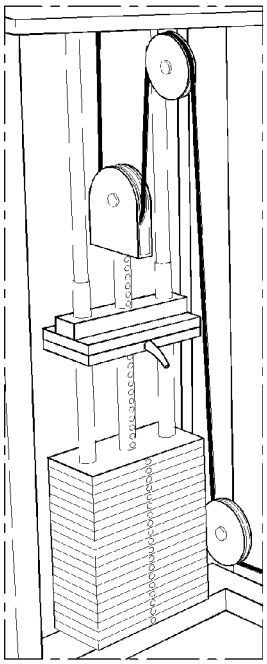
Fig. 1 Prior Art
FIG. 1 is a perspective schematic view of a known gravitational load group, partially cut away.
Figure 2A:
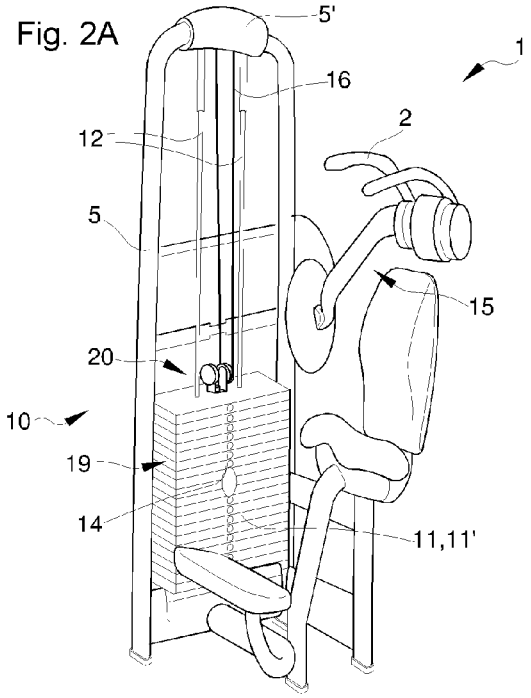
FIG. 2A shows a schematic perspective view of a gymnastic machine according to the present invention.

In FIG. 2A number 1 indicates, in its entirety, a gymnastic machine 1 comprising a frame 5 and a load group 10, preferably of the gravitational type, associated with this frame 5, and presenting an operating station provided with at least one interface 2 for a body portion of a respective user. In particular, hereinafter the term "gravitational load group" will refer, in general, to any load group, wherein the resistive action against a respective actuation is generated by moving a movable equipment in a respective attractive force field, not necessarily of the gravitational type, but also, for example, of the elastic or electromagnetic type. In more detail, each interface 2 is mechanically connected to the load group 10 by means of a transmission group 15, and comprises preferably, although without limitation, a respective gymnastic implement 2 to allow each user of the machine 1 to perform respective physical exercises against the resistance exerted by the load group 10. In this regard, it should be noted that the choice of representing in FIG. 2A a gymnastic machine 1 for training the abdominals is just by way of example and does not limit the protective scope and the generality of the present invention. In particular, it should be specified that the safety device according to the present invention can be freely and validly used in combination with any type of gymnastic machine, provided that this latter is provided with at least one respective gravitational load group.

With reference to FIG. 2B, the load group 10 is of the substantially known type and comprises a pair of parallel tubes 12 arranged along a first given direction V, for the sake of simplicity hereinafter considered preferably, although without limitation, vertical, these tubes being suitable to act as first guides 12 for a plurality of load elements 11. Each load element 11 preferably comprises a respective weight 11 of the known type, produced in metallic material, substantially parallelepiped shaped and dimensioned so as to present a given mass. In particular, each weight 11 presents preferably, although without limitation, a pair of first through holes 12' shaped to house with clearance the respective guides 12, a second through hole 18' obtained in a substantially central position of the weight 11 and oriented along the first given direction V, and a third through hole 14' obtained laterally along a second given direction L preferably transverse to the first given direction V, and that therefore hereinafter will be preferably considered horizontal. It should be noted that the set of these load elements/weights 11 substantially defines a stack 11' generally indicated as "weight stack" and presenting centrally a first through seat 18 defined by the set of the second holes 18' and therefore coaxial with the first given direction V.

This first seat 18 is shaped to house with clearance a support member 13 for the weights 11 that, as it will be better explained below, is carried movable by the transmission group 15 along the first given direction V. The support member 13 presents a head portion 13', shaped to engage in abutment the weight 11 arranged above in the stack 11', and a coupling portion 13" designed to couple stably with at least one respective weight 11. To this end, this coupling portion 13" comprises a bar that, in use, is oriented along the first given direction V and presents a plurality of fourth holes 14" obtained longitudinally in a stepped manner, and substantially identical in dimension and orientation to the third holes 14'. In use, when the head portion 13' abuts onto the stack 11', each fourth hole 14" is aligned with a respective third hole 14', and it is therefore sufficient to insert a blocking pin 14 to couple in a stable and selectively releasable manner the support member 13 with as number of weights 11 that can be defined by the user substantially at will. In particular, the first weight 11, into which the blocking pin 14 is inserted, will be directly connected to the coupling portion 13", whilst any weight 11 arranged above this first weight 11 in the stack 11' will be coupled in a substantially stacked manner between the first weight 11 and the head portion 13' of the support member 13. At this point it should be noted that hereinafter the reference number 19 will be used to indicate the movable equipment of the load group 10 comprising the support member 13 and each weight 11 directly or indirectly connected to it, and suitable, in use, to act as gravitational load resistant against any actuation of the interface 2 by a respective user. In this regard it should be noted that in the particular case in which the movable equipment 19 does not comprise weights 11, the support member 13, being provided with an its own mass, can be interpreted as a load element 11.

With particular reference to FIGS. 2A and 2B, the transmission group 15 connecting the movable equipment 19 to the interface 2 comprises a traction cable 16 and at least one first return element 17. In particular, the traction cable 16 preferably presents a respective first end 16' connected stably to the interface 2/gymnastic implement 2, and a respective second end 16" coupled stably to the frame 5, preferably, although without limitation, in the portion 5' of the frame 5 acting as stop for the first guides 12. In addition, the transmission group 15 comprises preferably, although without limitation, a plurality of pulleys 17 suitable to act as first return elements 17 to maintain, in use, the traction cable 16 constantly tensioned under the action of the gravitational load group 10 and of the interface 2. In particular, with reference to FIG. 2B, one of the pulleys 17 is preferably coupled, at the top, with the head portion 13' of the support member 13, and the transmission group 15, in its entirety, is designed so that an ascending motion of the weight stack along the respective guides 28 corresponds to each actuation of the interface 2 by a respective user against the resistance of the load group 10.

At this point, before detailing the configuration and the functioning principles of the safety device according to the present invention, it should be noted that the load group 10 is designed so that, during a correct execution of respective physical exercises, the movable equipment 19 moves along the respective first guides 12 with an alternating motion between a first initial position A and a second final position B of maximum elevation. To these operating positions of the movable equipment 19 will correspond two respective first and second heights along the given direction V that, for the sake of simplicity, will be indicated with the same letters A and B. In this regard it should be noted that hereinafter the term height will be used not only to refer to a given position along a vertical reference axis, but more in general it will be used to indicate a position relative to the frame 5 along the first given direction V, independently of its actual orientation. Just by way of example, the term height can be therefore validly used in the present document also to define a given position defined along an horizontal or inclined axis. At this point it should be specified that, during a correct execution of a given physical exercise wherein the transmission cable 16 is maintained constantly tensioned between the interface 2 and the frame 5, the first and second operating positions A and B of the movable equipment 19 correspond respectively to the initial and final operating positions of the interface 2 during each single repetition of a respective athletic movement by the user. Depending upon the gymnastic exercise performed and the gymnastic machine 1 used, the first and the second operating positions A and B of the movable equipment can be therefore defined by the structure and the operating configuration of the machine 1 or by the anthropometric measures and by the training modes of the user. In the first case, the first operating position A corresponds to a rest position for the weight stack where all the weights 11 are stacked one over the other and the stack 11' rests in a lower stop position of the first guides 12, whilst the second operating position B corresponds to a stop position for the interface 2. In the second case, the initial first operating position A and/or the final second operating position B of the movable equipment 19 can vary freely, but always within given structural limits depending upon the configuration of the gymnastic machine 1. In any case, independently of the fact that the first and second operating positions A and B, and therefore the respective heights A and B, are fixed or variable depending upon the user, it should be noted that, in use, the movable equipment 19, moving from the first height A to the second height B, acquires a given rising speed under the action exerted by the user and transmitted by the transmission cable 16. If this rising speed is particularly high, the movable equipment tends to move with a substantially inertial ascending motion, and to continue its rising also when, at the second height B, the action exerted by the user ends. Under these conditions, occurring for example when exercises are performed with reduced loads involving a series of repetitions in fast succession of a given athletic movement, the movable equipment 19 passes the height B and achieves a higher third height C defined each time by the intensity of the force pulse actually transmitted by the user to the movable equipment 19. As illustrated above in the Background to the invention, these substantially inertial ascending motions can cause the impact between the movable equipment 19 and the portion 5' of the frame, and therefore the damage of the gymnastic machine 1, or they can cause injuries to the users due to the sudden recoil resulting from the substantially free fall of the movable equipment 19 from the third height C down to the first height A.

With particular reference to FIGS. 2B and 3, to the load group 10 is associated a safety device 20 suitable, in use, to prevent substantially inertial ascending displacements of the movable equipment 19. This safety device 20 presents a return group 21 comprising preferably, although without limitation, an elongated elastic element 22, for example an elastic cable 22, presenting a respective first end portion 22' coupled integrally with the support member 13 so as to exert on this latter a return force F constantly oriented downwards, and therefore suitable to return the weight stack toward the respective first operating position A, and to maintain the traction cable 16 constantly tensioned during all the execution of a respective gymnastic exercise. Again with particular reference to FIGS. 2B and 3, it should be noted that the second end portion 22" of the elastic cable 22 is designed to be stably coupled to the frame 5 and, to this end, the safety device 20 comprises preferably, although without limitation, an abutment member 26 carried by the second end portion 22", and at least one first coupling member 27 carried rigidly by the frame 5 and shaped to couple in a stable and selectively releasable manner with the respective abutment member 26. In particular, with reference only to FIG. 3, the abutment member 26 comprises preferably, although without limitation, an abutment pin 26' oriented, in use, along a direction substantially transverse to the first and the second given direction V and L, whilst the coupling member 27 presents preferably a pair of hooks 27', whose respective hook-shaped portions face downwards to intercept and hold the abutment pin 26. In more detail, the abutment pin 26' presents preferably a pair of circular grooves 26" dimensioned and reciprocally spaced so as to be engaged, in use, by the hooks 27' and to give therefore stability to the coupling between the abutment member 26 and the first coupling member 27.

At this point, again with reference to FIG. 3, it should be noted that the head portion 13' of the movable equipment 19 presents a slide device 25 comprising respective second guides 23 integral with the head portion 13' and oriented along the second given direction L, and a slide 24 carried in a freely sliding manner by these second guides 23 and presenting a second coupling member 28 provided with a pair of hooks 28' similar to the hooks 27', but that present a greater distance between each other. These hooks 28' are shaped to engage the abutment pin 26 and to maintain it substantially coupled with the coupling member 13. The slide 24 furthermore presents a respective slot 24' shaped to house an abutment 24" projecting integrally from the head portion 13' of the support member 13 and suitable to engage in abutment the ends of the slot 24' so as to constrain the motion of the slide 24 between a third operating position P', wherein the abutment pin 26 is maintained by the hooks 28' in a position substantially overlapping the movable equipment 19, and a fourth operating position P", wherein the abutment pin 26 is maintained by the second coupling member 28 projecting relative to the movable equipment 19 and therefore, in use, this abutment pin 26' can be engaged by the first coupling member 27 and therefore maintained coupled with the frame 5 during displacements of the movable equipment 19. In view of what illustrated above with reference to FIG. 3, it is therefore clearly apparent that, when the slide 24 is in the respective third operating position P', the elastic cable 22 is maintained tensioned along a plurality of respective second return elements 29 and presents both the first and the second end portions 22' and 22" coupled to the support member 13. Therefore, under these conditions, to each movement of the movable equipment 19 a sliding of the elastic cable 22 along the pulleys will correspond, but the respective extension will remain constant and therefore no elastic return force F will be exerted on the movable equipment 19. On the contrary, when the slide 24 is in the respective fourth operating position P", the pin 26 carried by the hooks 28' is suitable to be intercepted and held by the first coupling member 27 in a position of stable coupling with the frame 5. It should be noted the positioning of the first coupling member 27 relative to the frame 5 along the first given direction V identifies and substantially defines a fourth height D at which the safety device 20 is suitable, in use, to start exerting the return force F on the support member 13. This fourth height D is preferably arranged between the first height A and the second height B but, in principle, it is also possible to define a fourth height D higher than the second height B. When the abutment member 26 engages the first coupling member 27, the elastic cable 22 presents the respective second end 22" engaged to the frame 5 and therefore during each ascending motion of the movable equipment 19 bringing the head portion 13' beyond the fourth height D, this elastic cable 22 is subjected to a respective action of traction/extension and generates on the support member 13 a corresponding elastic return force F that increases in intensity as the height achieved by the movable equipment 19 increases. Vice versa, when the movable equipment is in descending phase and the head portion 13' of the support member 13 achieves the height D, the second coupling member 28 engages the return pin 26 freeing it from the hooks 27' and coupling it to the slide 24.

Therefore, when the slide 24 is in the respective fourth operating position P", the safety device 20 is actuated and operating and is suitable, in use, to generate a return force F on the movable equipment 19 when this latter passes a height D determined by the position of the first coupling member 27 relative to the frame 5, whilst when the slide 24 is in the respective third operating position P' the safety device 20 is deactivated/not operating and the support member 13 is not subjected to return force F. It is therefore clearly apparent that the safety device 20 can be actuated and deactivated selectively by the user acting on the slide device 25, that can be therefore interpreted as a switching device 25 for switching the operating status of the safety device 20.

Figure 4:
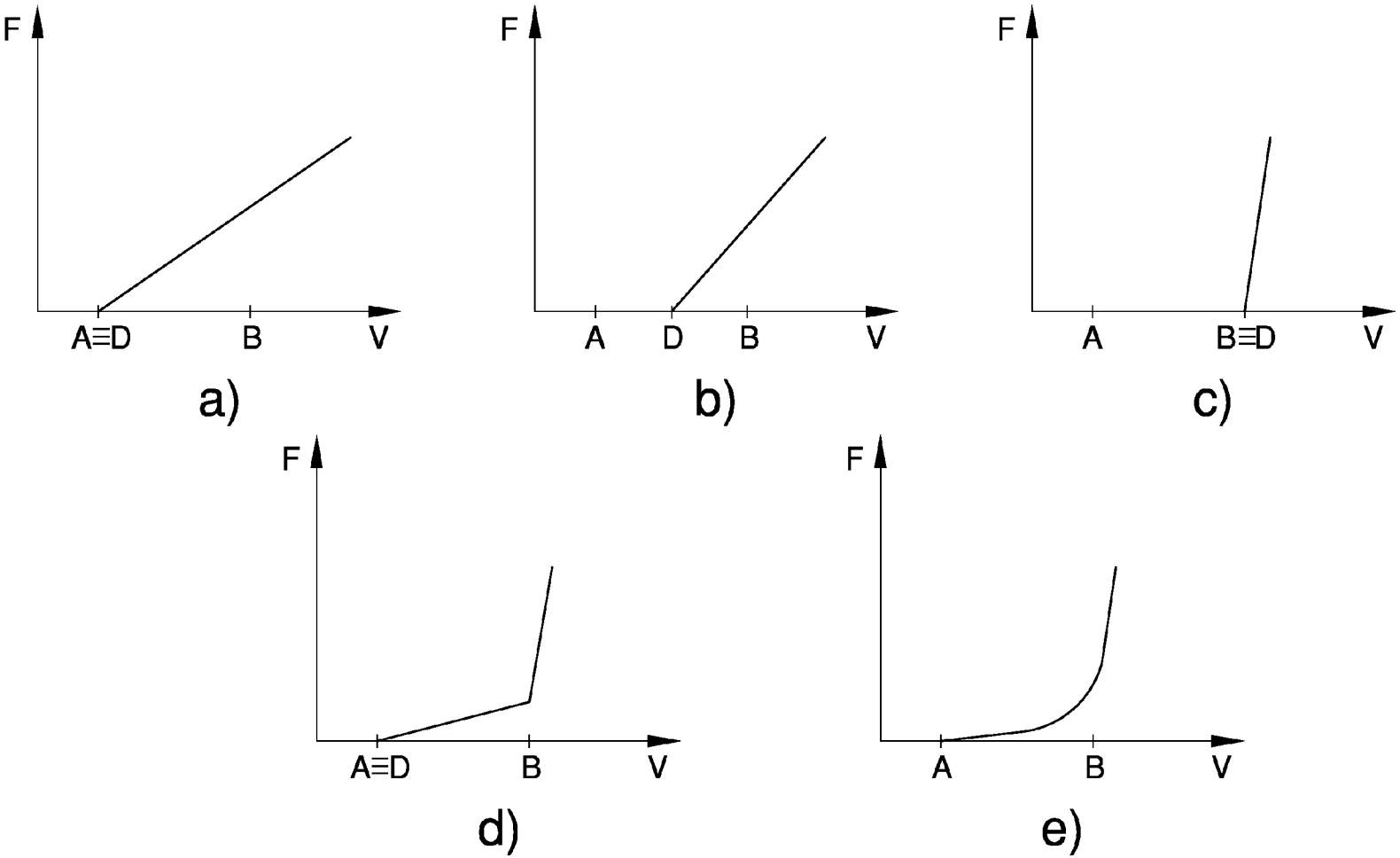
FIG. 4 is a diagram of the trend of the intensity of the return force exerted by a plurality of variants of a safety device according to the present invention.

At this point it should be noted that the intensity of the return force F exerted by the safety device 20 on the support member 13 will vary according to the physical characteristics of the return group 21 used. In particular, if a return group 21 provided with an elastic element 22 is used, the intensity of the return force F tends to progressively increase as the movable equipment 19 continues its ascending motion beyond the fourth height D. In more detail, if the elastic element 22 presents an ideal elastic behaviour, such as that described by the Hooke's law, the return force F will increase linearly according to the spring constant typical of the elastic element 22 used. In this case, the return force can be substantially negligible whilst the movable equipment 19 moves between the first and second heights A and B, and can achieve a significant value only when the movable equipment 19 passes this second height B. With reference to FIG. 4, the variation in the return force F along the first given direction V will depend upon both the positioning of the height D and the spring constant of the elastic element 22, and it will be therefore possible to vary these two parameters to define the dynamic behaviour of the safety device 20. For example, as illustrated in FIGS. 4*a*, 4*b*, and 4*c*, it will be possible to define a return force that starts to be exerted as the weight stack leaves the respective first operating position A and increases slowly (low spring constant) as the movable equipment 19 increases its height, or it will be possible to define a return force that starts to be applied only near the second operating position B, but that increases quickly (high spring constant) as the movable equipment 19 goes up. Alternatively, it is possible to use an elastic element 22, which presents a non linear elastic response and, as illustrated for example in FIG. 4*d*, is suitable to generate a return force F increasing slowly and linearly whilst the movable equipment 19 moves from the first operating position A to the second operating position B, but increases quickly its intensity when the movable equipment 19 passes the second operating position B following a substantially inertial ascending motion. In particular, such an elastic non linear element 22 can be produced, for example, by coupling elastic elements of different extension and spring constant, or by using cables wherein there are a core, produced in a first given elastic material, and a sheath, obtained by coiling substantially in a spiral manner a second given elastic material presenting a spring constant different than that of the first material.

The use of the safety device 20 and of a gymnastic machine 1 and of a load group 10 provided with this safety device 20 is clearly apparent from the description above and does not require further explanations.

It is furthermore apparent that modifications and variants can be made to the safety device 20 described and illustrated herein, without however departing from the protective scope of the present invention.

For instance, according to a first not illustrated variant of the safety device 20, each return group 21, instead of comprising an elongated elastic element 22 suitable to exert a traction force on the movable equipment 19, could comprise at least one repelling element 32 suitable to exert on the upper portion of the movable equipment 19 a thrust action downward that can be interpreted as a return force F toward the first operating position A. This repelling member 32 can preferably comprise at least one spiral spring 32' carried integrally by the portion 5' of the frame 5 and arranged, in use, between this portion 5' and the stack 11' so as to exert a thrust force with intensity that increases as the movable equipment 19 moves towards the respective stop during its ascending motion. Clearly, adequately dimensioning the longitudinal extension of the springs 32' and selecting the respective spring constant, it will be possible to define both the fourth height D, at which the safety device 20 starts to exert the respective return force F on the movable equipment 19, and the change in intensity of this force F along the first given direction V. In this case again, the use of a plurality of springs 32' with different longitudinal extension and spring constant, allows to generate a return force F that presents a non linear development according to the increase in the height of the movable equipment 19 along the first given direction V.

Alternatively, according to a further variant of the present invention, the safety device 20 comprises at least a pair of magnets 42, of which a first magnet 42 is carried superiorly by the movable equipment 19, whilst a second magnet 42 is carried rigidly by the portion 5' of stop of the guides 12. In more detail, the first and the second magnets 42 are oriented so that, when they interact one with the other, a repulsive action is generated, whose intensity increases as the movable equipment 19 continues its ascending motion beyond the respective second operating position B and moves towards the stop portion 5'. These magnets 42 can be of the permanent type or they can be electromagnets, without however limiting the scope of the present variant.

In this case again, as illustrated in FIG. 4*e*, selecting the magnetic characteristics of the first and second magnets 42 it will be possible to define the trend of the intensity of the repulsive force along the first given direction V so that this intensity is substantially negligible while the movable equipment 19 moves between the respective first and second operating positions A and B, while it increases quickly as the support member 13 goes up to a height greater than the second height B.

In view of the above description it is clearly apparent that the safety device 20 and the use thereof in a gymnastic machine 1 provided with at least one gravitational load group 20 allow to solve the technical problem under examination, i.e. they allow to prevent substantially inertial ascending motions of the movable equipment 19 of the load group 10 to avoid undesired drawbacks, among which, for example, injuries to the users of the gymnastic machine 1. In particular, it should be noted that the return force F generated by the safety device 20 is suitable to damp each inertial component of the ascending motion of the movable equipment 19 without significantly disturb the correct execution of physical exercises, for example varying in undesired manner the resistant load exerted by the load group 10 when the movable equipment 19 moves correctly between the respective first and second operating positions A and B.

The use of the safety device 20 allows therefore a user to perform continuously and substantially homogeneously a physical exercise comprising a series of repetitions of a given athletic movement. In more detail, the device 20 is suitable, in use, to maintain the traction cable 16 constantly tensioned, and therefore suitable to prevent the user from feeling pulls and recoils. In other words, the user feels like a continuity and "homogeneity" in performing exercises and in particular in the resistive action exerted by the load group 10. It should be furthermore noted that during execution of physical exercises with heavy resistive loads, it is not necessary to exert a return force F on the movable equipment 19, as the resistive action of the load is sufficient to prevent substantially inertial ascending motions of the movable equipment 19. Therefore, without the safety device 20 the user feels a "discontinuity" in the execution of the physical exercises as, with reduced loads, he/she must limit his/her action so as not to cause substantially inertial motions of the movable equipment, while with greater resistive loads he/she can act freely, freeing all his/her force and speed of execution. In view of the above description, the safety device 20 can be therefore interpreted also as a homogenizer of the execution of physical exercises, as it allows the user both to perform physical exercises exerting a continuous and homogeneous action, i.e. an action without pulls or sudden changes in intensity, and to perform physical exercises exerting all his/her force and speed of execution also in the presence of limited resistive loads, without causing substantially inertial displacements of the movable equipment. In this way the user can focus on his/her physical activity without limiting his/her activity in the presence of reduced resistive loads and without feeling a difference or heterogeneity in the execution of the respective gymnastic exercises depending upon the selected resistive load or execution mode.

We claim:

1. A safety device for a gymnastic machine provided with a frame and with a gravitational load group connected to an interface designed so as to allow a user of said gymnastic machine to perform exercises against the action of said load group; said load group including a movable equipment provided with at least one load element carried, in a freely sliding manner along a given direction, by respective guiding means associated with said frame; said safety device comprising:

first coupling means carried integrally by said frame;

return means including at least one elongated elastic element adapted to connect said frame to said movable equipment to exert a given return force on said movable equipment so as to prevent substantially inertial ascending displacements thereof; said at least one elastic element having a respective first end portion rigidly coupled to said load group, and a second end portion provided with abutment means shaped so as to couple in a stable and selectively releasable manner with said first coupling means; and a mechanical switching device adapted to enable selectively the coupling between said abutment means and said first coupling means in order to allow a user to selectively switch between an actuated or deactivated operative status of said return means.

2. A safety device according to claim 1, wherein said return means are designed so as to exert said return force when at least a given portion of said movable equipment is positioned above a first given height along said given direction.

3. A safety device according to claim 1, wherein said return means are designed so as to exert a said return force, whose intensity increases progressively and continuously as the height of said movable equipment along said first given direction increases.

4. A safety device according to claim 1, wherein said elastic element presents a non linear elastic behaviour, wherein the respective spring constants varies according to the position of said movable equipment relative to said frame along said given direction.

5. A safety device according to claim 4, wherein the spring constants of said elastic element, and therefore the intensity of said return force, suddenly increases when at least a said given portion of said movable equipment overtakes a second given height along said given direction.

6. A safety device according to claim 1, wherein said load group comprises a plurality of said load elements, substantially stacked along said guiding means, and a support member associated with said movable equipment, which can be mechanically connected to said interface, so as to be moved, in use, by a said user along said given direction, and designed to couple in a stable and selectively releasable manner with a given number of said load elements so as to vary the overall load which can be applied, in use, to said interface.

7. A safety device according to claim 6, wherein said first end portion is rigidly coupled to said support member.

8. A safety device according to claim 7, wherein said abutment means comprises an abutment pin and wherein said coupling means comprise at least a pair of hooks shaped so as to house and hold, in use, said abutment pin.

9. A safety device according to claim 1, wherein said switching device is carried by said movable equipment and comprises a slide shaped so as to carry said abutment means and adapted to vary a respective operating position thereof, so as to enable the engagement of said coupling means by said abutment means.

10. A safety device according to claim 1, wherein said switching device is carried by said frame and comprises a slide which carries integrally said first coupling means and is adapted to vary a respective operating position thereof, so as to enable the engagement by said abutment means.

11. A method for keeping safe the use of a gravitational load group for gymnastic machines provided with a respective movable equipment designed so as to move, in use, with alternating motion along a given direction; said method comprising:

exerting a return force, directed constantly downwards, on said movable equipment by means of elastic return means stably connected to said movable equipment so as to prevent substantially inertial ascending displacements thereof; and selectively coupling said elastic return means to said frame by means of a mechanical switching device.

12. A method according to claim 11, wherein said step of exerting a return force is carried out only when at least a portion of said movable equipment is positioned above a given height along said given direction.

13. A method according to claim 11, wherein said step of exerting a return force further comprises varying the intensity of said return force according to the position of said movable equipment along said given direction.

* * * * *